United States Patent [19]

Simpson

[11] 3,950,900

[45] Apr. 20, 1976

[54] METHOD AND CLIP FOR INSTALLATION OF INSULATION

[76] Inventor: Ronnie C. Simpson, Rte. 1 Box 294, Carl Junction, Mo. 64834

[22] Filed: Aug. 22, 1974

[21] Appl. No.: 499,445

[52] U.S. Cl. ..... 52/22; 52/502

[51] Int. Cl.[2] ..... E04B 7/00

[58] Field of Search ..... 52/22, 404, 502, 627, 52/628, 94, 60; 160/394, 397

[56] References Cited

UNITED STATES PATENTS

| | | | |
|---|---|---|---|
| 1,053,199 | 2/1913 | Moore | 160/394 |
| 1,171,952 | 2/1916 | Higgin | 160/394 X |
| 3,336,704 | 8/1967 | Clay | 52/22 X |
| 3,766,700 | 10/1973 | Nuss | 52/502 X |

*Primary Examiner*—J. Karl Bell
*Attorney, Agent, or Firm*—James H. Chafin

[57] ABSTRACT

An eave strut clip for installation of roof insulation in metal building structures to prevent leaking of moisture from the eave strut back along the insulation. The clip comprises an elongated flexible metal strip having an outwardly extending flange at each end thereof for use in conjunction with an eave strut having a cross-sectional C-shape. The edge of the insulation is pulled into the open space of the eave strut, the clip being bent to conform to the inside surface of the eave strut and held in place by the resilient force of the clip thereby gripping and holding the edge of the insulation between the clip and the inside surface of the eave strut.

7 Claims, 7 Drawing Figures

METHOD AND CLIP FOR INSTALLATION OF INSULATION

BACKGROUND OF THE INVENTION

1. Field of the Invention

The present invention relates to installation of building insulation material and more particularly to a method and means for clamping the edge of roof insulation in metal buildings to the eave strut to prevent exposure thereof to rain and moisture.

2. Description of Prior Art

In the construction of metal buildings, strip insulation is normally provided between the purlins and the roof sheet, the outer ends or edges of said insulation being attached to the top of an eave strut.

The insulation is normally of a type having spun fiberglass material in a sheet which is faced on one side with a vinyl or foil material glued thereto for purpose of providing a vapor barrier.

Upon construction of metal buildings the insulation is pulled over the purlins with the vapor barrier down or facing the interior of the building. The ends or edge of the insulation is then attached to the top surface of an eave strut. The recommended correct way to attach to the eave strut is to fold back the edge of the insulation with vapor barrier outside and then using rivets, screws or the like, to attach the folded edge to the top of the eave strut. This prevents the fiber portion of the insulation from being exposed to the weather between the eave strut and the roof sheet.

However, in practice, it has been found that due to constant time pressure for completion of said buildings and the low degree of skilled labor used, the edge of the insulation is usually left unfolded and exposed to the weather between the eave strut and the roof sheet. During rain, snow or wet weather, water or moisture is wicked back along the insulation fiber and there accumulates until the insulation starts sagging.

At this point the user of the building does not know whether there is a leak in the roof or wicking has occurred. Often much time and labor is expended fruitlessly searching for a roof leak that doesn't exist.

SUMMARY OF THE PRESENT INVENTION

The present invention is particularly designed and constructed to overcome the above disadvantages and prevent moisture accumulation due to wicking as hereinbefore described. Since the eave strut in most metal buildings has in cross-sectional C-shape with the open face thereof directed inwardly, the insulation edge may be inserted into this open face of the eave strut below the top surface thereof.

An insulation clip comprising an elongated flexible metal strip which will tend to spring back to its original shape is used to clamp the insulation in place inside the C-shaped eave strut. The strip is provided with inwardly facing flanges at each end thereof, which will substantially conform to the inside shape of the eave strut when deformed to be inserted therein.

The insulation clip is bent into a substantially C-shaped configuration and inserted into the eave strut below the insulation edge. Upon releasing the clip it will tend to spring open thereby firmly clamping the edge of the insulation between the upper end of the clip and inside surface of the eave strut.

The roof sheet is then installed on top of the eave strut and sealed to prevent moisture from entering through the area between the roof sheet and the eave strut.

The clip insulation serves not only to prevent moixture accumulation but represents significant savings in labor due to the ease of installation as opposed to installation by the fold back and rivet method hereinbefore set forth.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENT

Figure 1:
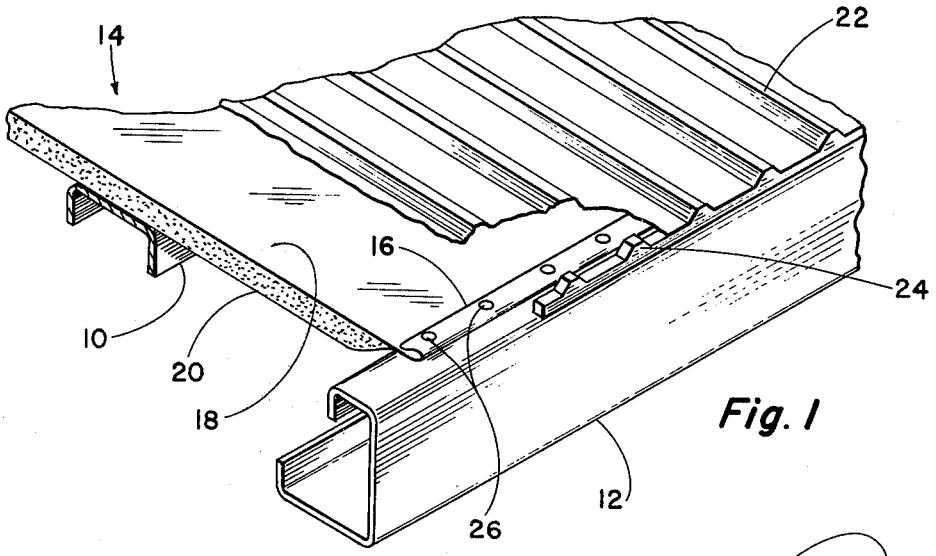
FIG. 1 is a prospective view of the proper method of installing insulation by the prior art technique.

Referring to the drawings in detail, FIG. 1 depicts a typical metal building roof eave structure. The structure generally comprises a plurality of spaced elongated parallel roof purlins, one of which is shown and indicated by reference character 10. These roof purlins make up the frame work for the roof and terminate at the edge with an eave strut 12 having a cross-sectional C-shape with the open face thereof facing inwardly toward the inside of the building. The eave struts are supported by vertically disposed frame members (not shown).

A plurality of insulation strips or blankets, generally indicated by reference character 14, are pulled tightly over these purlins with the outer edge 16 thereof terminating at the eave strut 12. The insulation blankets 14 generally comprise a blanket of spun fiberglass which ranges from 1 to 2 inches thick and which is very compressible. The lower surface of the fiberglass blanket 18 is provided with a vapor barrier 20 which is normally of a vinyl or foil material and is glued to the fiberglass 18 by suitable adhesive.

A roof sheet 22 which is normally constructed of corrugated metal material is then laid over the fiberglass blanket and attached to the purlins 10 by means of screws or rivets (not shown). The outer edge of the corrugated sheets 22 is secured to the top surface of the eave strut 12. Normally, to close the space between the edge of the roof sheet 22 and the upper surface of the eve strut 12, a rubber or plastic molding 24 is placed between the said eave strut 12 and the roof sheet 22, the said molding 24 having an upper surface which conforms to the shape of the corrugation of the roof sheet 22.

FIG. 1 depicts the correct way of installing the insulation in accordance with this prior art structure hereinbefore set forth. It is recommended by the designers of the buildings that the edge 16 of the insulation be folded back as shown in FIG. 1 and attached to the top of the eve strut by means of rivets or screws 26. By folding the edge back in this manner the foil portion 20 lies outside the fold and serves to prevent moisture from coming into contact with the fiberglass material 18.

Figure 2:
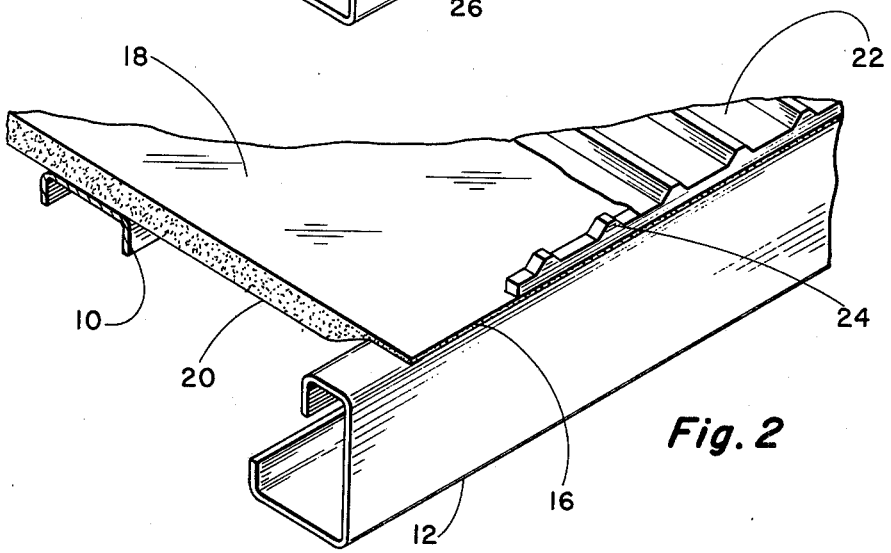
FIG. 2 is a prospective view of an improper method of installing insulation by the prior art method.

However, it has been found to be common practice due to the constant pressure of time to complete the structure and the use of relatively unskilled labor in assembling these metal buildings, that the edge 16 of the insulation is often pulled tightly against the upper surface of the eave strut and left unfolded as shown in FIG. 2. The roof sheet 22 and associated rubber molding 24 is then installed over the purlins and the eave strut and secured thereto with the outer edge of the insulation or fiberglass material 18 being exposed to the outer surface of the building. This improper insulation is often missed during inspection of the building due to guttering or other eave flashing (not shown) which is usually added along the eave strut of the building after completion of the roof insulation.

Often after this improper installation, as depicted in FIG. 2 and many times after the building has been occupied and in use, the edge of the building is subject to prolonged exposure to moisture during the rainy seasons or due to snow and ice melting on top of the building thereby causing wicking of this moisture back along the fiberglass material. This in turn causes a great amount of moisture accumulation in the fiberglass material 18 itself. This accumulation of moisture is prevented from drying inside the building due to the vapor barrier 20 on inside surface thereof. Therefore, the moisture has no place to go and continues to accumulate. After much accumulation the insulation starts to sag, thereby indicating to the user of the building that there is a roof leak. It is often the case that many labor man hours are used in searching for a roof leak that doesn't exist before it is discovered that wicking action has taken place due to improper installation of the insulation.

Figure 3:
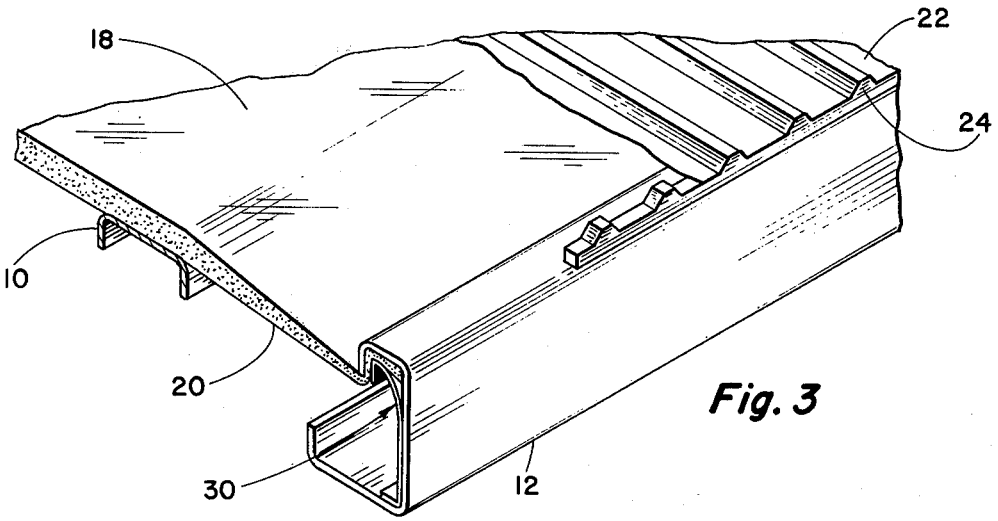
FIG. 3 is a prospective view of a roof eave having insulation installed by using clips embodying the present invention.

The present invention as shown in FIG. 3 depicts a method and means for pulling the edge 16 of the insulation over the top surfaces of the purlins and into and through the open face of the eave strut 12. The insulation is then clipped to the upper inside surface of the eave strut 12 by means of a plurality of insulation clips, one of which is shown and indicated by reference character 30.

Figure 4:
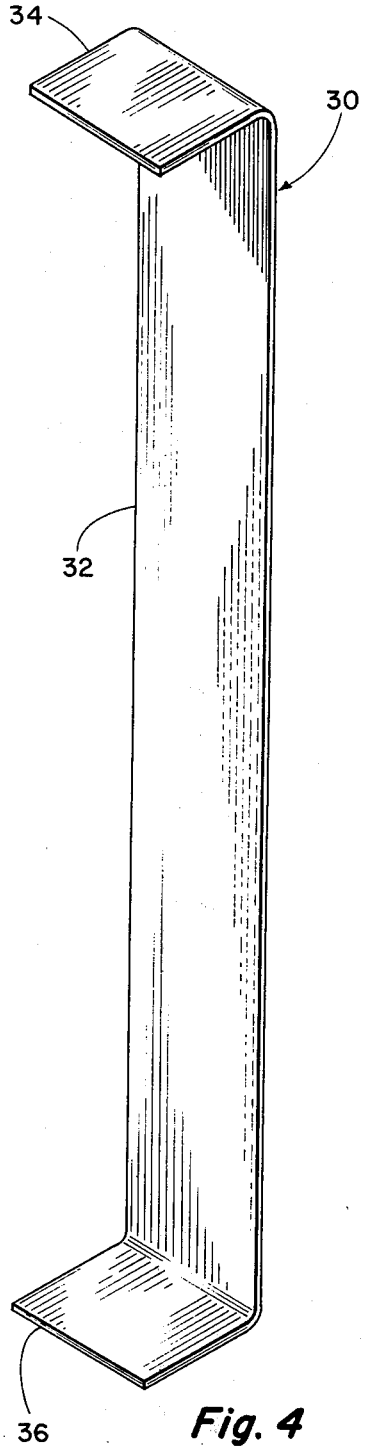
FIG. 4 is a detailed prospective view of the clip of FIG. 3.

Referring now to FIG. 4 the clip member 30 generally comprises an elongated flexible metal strip 32 having a flange 34 secured to the upper end thereof and oppositely disposed flange 36 secured to the lower end thereof, thereby forming a cross-sectional C-shape. As readily apparent, the flanges 34 and 36 may be made as an integral part of the elongated strip 32 by simply bending the ends of the strip 32, thereby providing a smooth curvature along the bent edges thereof. This serves to prevent damage to the insulation material as will be hereinafter set forth. The clip member 30 may be constructed of any suitable flexible metal such as steel or aluminum or could be conceivably constructed of a plastic composition so long as the clip member may be deformed and after having been deformed will tend to spring back to its original shape as depicted in FIG. 4.

Figure 5:
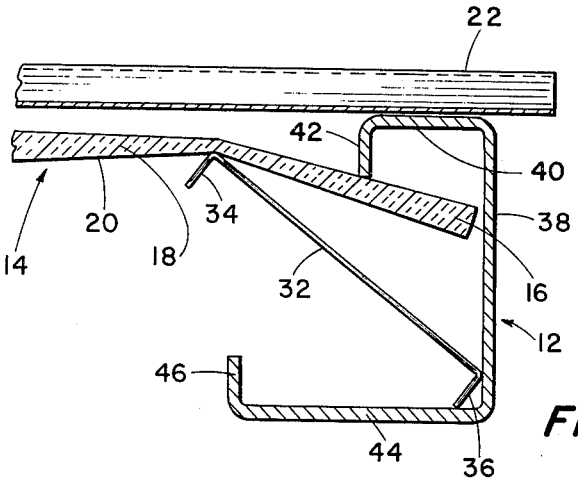
FIGS. 5, 6 and 7 are elevational cross-sectional views depicting the step of installing insulation using the insulation clip of FIGS. 3 and 4.
Figure 6:
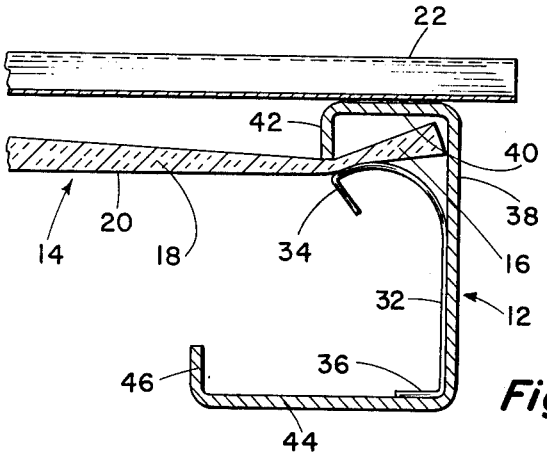
Figure 7:
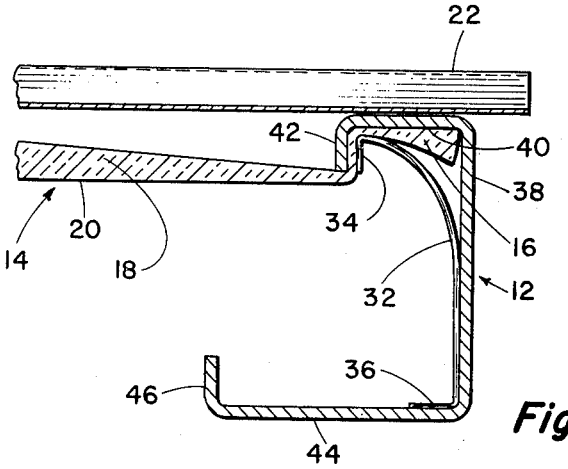

Referring now to FIGS. 5, 6 and 7 the eave strut member generally indicated by reference character 12 normally has an outside surface 38, a top inwardly directed surface 40 terminating in a downwardly extending lip member 42. The bottom edge of the outer surface 38 is provided with an inwardly extending bottom surface 44 terminating in an upwardly extending lip member 46, thereby forming a substantially cross-sectional C-shape with the open face thereof directed inwardly toward the interior of the building. Installation of the insulation material 14 is accomplished by stretching said insulation material over the purlins 10 as shown in FIG. 3 with the outer edge 16 of the insulation material being pulled tightly into the open face of the eave strut 12. The insulation clip member 30 is then placed at an angle with the flange member 36 extending into the inside surface of the eave strut 12 and resting against the juncture of the outer surface 38 and lower surface 44 of the eave strut 12. The upper flange member 34 is placed against the paper barrier 20 of the insulation material 14, and pressure is then applied to the elongated portion 32 of the clip thereby forcing the said clip back into the inside surface of the eave strut as shown in FIG. 6. This is accomplished by deforming or bending the clip member 30 in order for the upper end to pass under the lip 42 of the eave strut 12. It is apparent that the flange member 36 will be brought to rest against the surface member 44 of the eave strut, while the lower portion of the strip member 32 will rest directly against the surface member 38 of the eave strut 12.

After the upper end of the clip member 30 is forced past the lip member 42 of the eave strut, it will tend to straighten out. Thus, the upper end of the clip member is forced against the juncture of the lip member 42 and the upper surface 40 of the eave strut 12, thereby firmly clamping the edge portion of the insulation between the clip member and the inside surface of the eave strut 12.

It is readily apparent that the clip member 30 should be of a sufficient length to conform to the inside surface of the eave strut as shown in FIG. 7 to maintain a tight fit. A plurality of clip members 30 are then provided all along the edge of the insulation. It has been found that a spacing of ½ to 2 feet between the clip members is normally sufficient to provide adequate clamping of the edges of the insulation material.

The roof sheet 22 and associated molding 24 may be then installed in a normal manner which will tend to prevent moisture or rain from blowing back between the roof sheet 22 and the eave strut 12 into the area of insulation 14.

From the foregoing it is apparent that the present invention provides a novel method and means for securing the edges of insulation material in metal building construction to prevent exposure of the edge thereof to the weather and hence prevent wicking of moisture back through the insulation material.

Whereas the present invention has been described in particular relation to the drawings attached hereto it is obvious that other and further modifications, apart from those shown or suggested herein, may be made within the spirit and scope of this invention. For example, the drawings depicted herein indicate a flat roof structure whereas this installation technique and means may be used with sloping roof structures or with eave struts having modified cross-sectional configurations.

What is claimed is:

1. In combination with a metal structure roof having an eave strut along the edge thereof, said eave strut having a substantially cross-sectional C-shape, the open face thereof directed inwardly, and having insulation on the inside surface of the roof, the edge of the insulation terminating within the open face of the eave strut;

a deformable clamp means removably insertable within the inside surface of the eave strut, a portion of said clamp means being adaptable for contacting the edge of the insulation thereby securing the edge of the insulation to the inside surface of the eave strut, said portion of the clamp means for contacting the insulation being blunted to prevent damage to the insulation.

2. A device as set forth in claim 1 wherein the deformable clamp means comprises an elongated strip of flexible material which is capable of being deformed to conform to the inside surface of the eave strut, said material having a tendency to return to its original shape after deformation thereof.

3. A device as set forth in claim 2 wherein the blunted portion of the clamp means comprises a flange member secured at one end of the elongated strip, the intersection of the flange member with the elongated strip being rounded to prevent damage to the insulation.

4. A device as set forth in claim 3 wherein the elongated strip is provided with a substantially identical flange member at the opposite end thereof to form a substantially cross-sectional U-shape, the clamp means being capable of being deformed into a substantially C-shape to conform to the inside surface of the eave strut.

5. A device as set forth in claim 4 wherein the flanges are formed as an integral part of the elongated strip.

6. A device as set forth in claim 5 wherein the clamp material is of metal.

7. A method of installing insulation on the inside surface of a metal roof structure having an eave strut along the edge thereof, said eave strut having a substantially cross-sectional C-shaped, the open face thereof directed inwardly, a roof sheet covering the structure and the edge of the roof sheet being attached to the top of the eave strut, comprising the steps of:

a. attaching blanket insulation material to the inside surface of the roof sheet;

b. pulling the edge of the insulation into the open face of the eave strut, and c. clamping the edge of the insulation to the inside surface of the eave strut.

* * * * *